United States Patent [19]

Thomas

[11] Patent Number: 4,679,356

[45] Date of Patent: Jul. 14, 1987

[54] AUTOMATIC SKI TUNING DEVICE

[76] Inventor: Jacques B. Thomas, P.O. Box 3111, Winter Park, Colo. 80482

[21] Appl. No.: 861,604

[22] Filed: May 9, 1986

[51] Int. Cl.[4] ..... B24B 9/00

[52] U.S. Cl. ..... 51/205 WG; 51/241 S

[58] Field of Search ..... 51/241 S, 170 T, 205 WG; 76/83, 88

[56] References Cited

U.S. PATENT DOCUMENTS

| | | | |
|---|---|---|---|
| 3,159,951 | 12/1964 | Winbauer | 51/170 PT |
| 3,412,508 | 11/1968 | Schell, Jr. | 51/170 R |
| 3,512,308 | 5/1970 | Schell, Jr. | 51/170 T |
| 3,585,760 | 6/1971 | Richmond | 51/170 EB |
| 3,899,942 | 8/1975 | Bradbury | 51/208 |
| 4,030,382 | 6/1977 | Nilsson et al. | 51/205 WG |
| 4,442,636 | 4/1984 | Obland | 51/205 WG |

*Primary Examiner*—Roscoe V. Parker

*Attorney, Agent, or Firm*—Gary M. Polumbus

[57] ABSTRACT

A device is disclosed for movement along the bottom surface of a snow ski to grind a varying bevel in the bottom edges of the ski in direct relation to the width of the ski.

15 Claims, 16 Drawing Figures

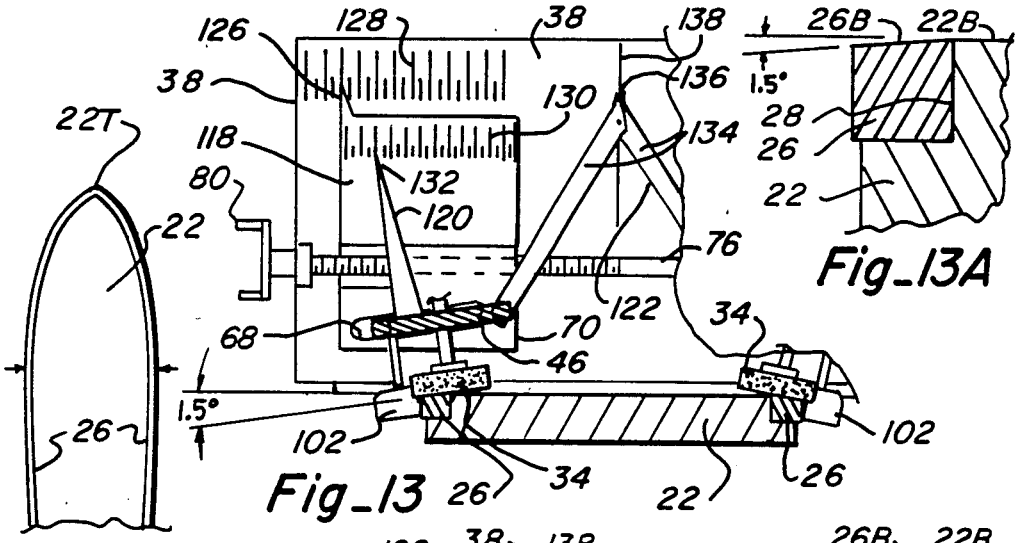
Fig_13A
Fig_13
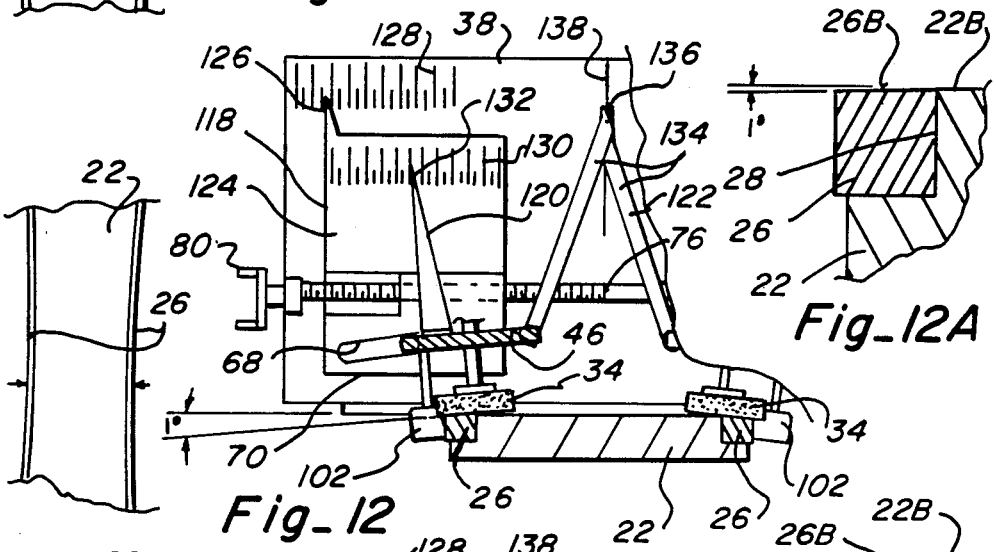
Fig_12A
Fig_12
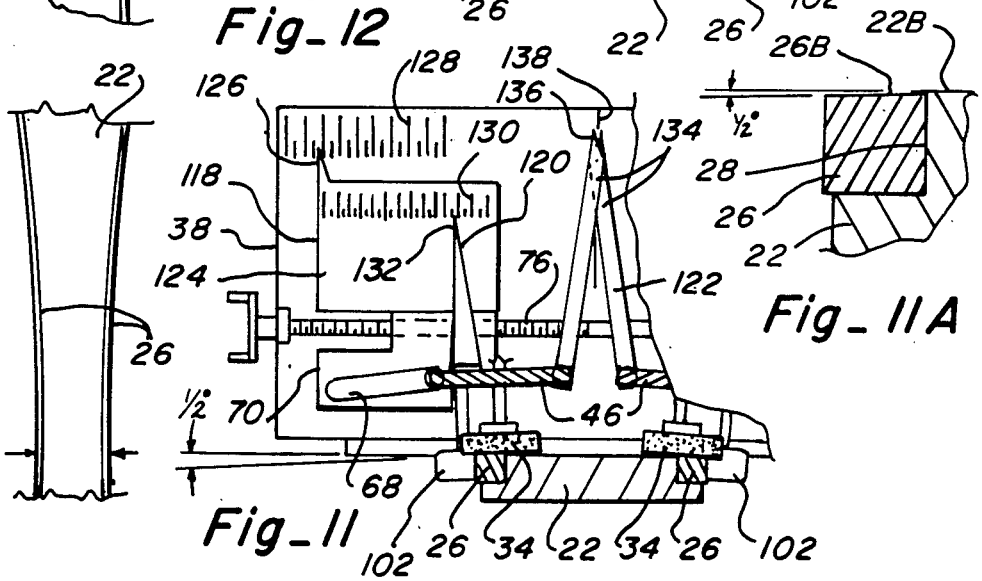
Fig_11A
Fig_11

AUTOMATIC SKI TUNING DEVICE

BACKGROUND OF THE INVENTION

1. Field of the Invention

This invention relates generally to devices for tuning snow skis and, more particularly, to a device adapted to automatically bevel the metal edges of snow skis in direct corrolation with the width of the ski.

2. Description of the Prior Art

Snow skis that are utilized for alpine skiing are made from various materials, including wood, plastic, fiberglass and the like but, regardless of the material from which the ski is made, they all contain metal edges extending along the length of the ski on opposite sides of the bottom surface of the ski in coplanar relationship therewith. The metal edges when fabricated into the ski have an outer edge forming a right angle with the vertical side walls of the ski, but if this right angle were to extend the entire length of the ski, it would be very difficult to turn the skis, as the right angle on the edge inhibits the turning of the ski and encourages the ski to tract straightforwardly. Accordingly, it is desirable to facilitate turning of the skis to place a slight bevel on the metal edges so that the bottom surface of the metal edge forms a slight angle, sometimes up to 2 degrees, relative to the bottom surface of the ski.

It is desirable to have the maximum bevel near the leading and trailing ends of the ski to reduce the resistance to lateral movement at these locations so that the skis are easier to turn. A very minor bevel is desirable near the longitudinal center of the ski so that it is easy to carve turns and get a firm grip on the snow for control during a turn.

Alpine snow skis have another similar characteristic in that the leading and trailing ends of the skis are wider than the longitudinal center of the ski. Accordingly, Applicant has concluded that the bevel placed on the metal edges can have a direct relationship to the width of the ski so that the greater the width, the greater the bevel should be. Accordingly, near the leading and trailing ends of the ski, where it is widest, the bevel is the greatest so as to enable the skis to be turned easily. Similarly, at the longitudinal center of the ski, where the ski is narrowest, the bevel is the smallest to enable the desired carving of the ski through turns.

Most alpine skis are fabricated with different materials which are bonded together with various resins or other bonding mediums, and these bonding mediums typically take weeks to cure. For this reason, the manufacturers of alpine snow skis typically ship the skis to retail locations before the bonding medium has totally cured. Accordingly, when the skis finally reaches the retail destination or shortly thereafter, and the bonding medium has cured, the various bonded components of the skis may have contracted during the curing process so that the bottom surface of the skis are not smooth, as desired, and may not be coplanar with the metal edges. Accordingly, after the skis have reached the retail destination, it is necessary to tune the skis by grinding the bottoms of the skis so that they are smooth, as desired, and then filing the metal edges until the bottom surfaces thereof are substantially coplanar with the bottoms of the skis. The metal edges should be beveled during this same tuning process so as to increase the angle between the bottom surfaces of the metal edges and the bottom surfaces of the skis near the leading and trailing ends of the skis so that the skis will properly perform for the ultimate purchaser.

Traditionally, the process of grinding the desired bevel into the bottom surface of the metal edges has been performed by hand, and typically by a worker at a retail shop who is frequently not well trained to place the desired bevel on the metal edges. Even a very skilled and experienced worker in this field has trouble with a hand file in placing a uniform bevel on both sides of the ski due to the fact that it is a manual process subject to human error and is frequently performed solely from feel developed through experience. It has been found that it requires a skilled worker three or four months to train a new worker, and even after months of training, the tuning process takes a considerable amount of time. Further, due to the fact that the skis cannot be tuned at the manufacturing site because they are usually shipped before the bonding medium has completely cured, it is a natural consequence that the tuning of skis, including the beveling of the metal edges, is done by a large number of people resulting in a lack of uniformity from retail location to retail location. Accordingly, the ultimate purchaser of the skis does not get a predictable product.

It is to overcome the above-noted problems that the present invention has been developed.

The prior art known to Applicant discloses several systems for automatically sharpening the metal edges of snow skis, but in each instance, the device is limited to a system which grinds a right angle to the edge of the ski and makes no provision for beveling the edge. Examples of such prior art systems are disclosed in U.S. Pat. No. 3,159,951, issued to Windbauer; U.S. Pat. No. 3,585,760, issued to Richmond; U.S. Pat. No. 3,899,942, issued to Bradbury; and U.S. Pat. Nos. 3,412,508 and 3,512,308, each issued to Schell, Jr.

U.S. Pat. No. 4,442,636, issued to Obland, discloses a hand-operated device for simultaneously sharpening both edges of a ski, but again, the edges are sharpened at right angles, and there is no suggestion of means for beveling the edges of the ski.

U.S. Pat. No. 4,030,382, issued to Nilsson, et al., discloses a device for sharpening the steel edges of a ski and includes an embodiment wherein the sharpening element of the device can be inclined so that an angle less than 90 degrees can be imparted to the metal edge establishing a bevel as opposed to a right-angled edge on the ski. This device, however, has no suggestion of relating the bevel to the width of the ski.

SUMMARY OF THE INVENTION

The present invention relates to an automatic, hand-held tool designed to grind a predetermined bevel into the metal edges of snow skis whereby the angle of the bevel can vary along the length of the ski in a desired manner.

The device utilizes a pair of grinding wheels, which are adapted to engage the bottom surface of the metal edges on a ski and grind a predetermined, but variable, angle on the metal edges as the device is moved along the length of the ski. The device includes an operative mechanism adapted to sense the side cut or width of the ski as the device is moved along the length of the ski and, in direct response to the width of the ski, vary the angle of the grinding wheels so that the angle of bevel placed on the metal edges varies in direct relation to the width of the ski. The operative mechanism effects a greater angle of bevel (i.e. a larger angle between the bottom surface of the metal edge and the bottom surface of the ski) at wider locations along the length of the ski so that a greater bevel is established near the leading and trailing ends of the ski where the ski is the widest.

In this manner, as the device is moved along the length of the ski, a relatively large angle of bevel, for example approaching 2 degrees, is established near the trailing end of the ski, and as the device advances toward the leading end of the ski and approaches the longtudinal center of the ski, where the ski is narrower, the angle of bevel is reduced, for example to approximately 0.5 degrees. Subsequently as the device is further advanced toward the leading end of the ski where the ski is again wider, a greater angle of bevel is established. Accordingly, the metal edges are beveled so as to have a greater angle of bevel near the leading and trailing ends to enable the ski to be turned more easily and a relatively smaller angle of bevel near the longitudinal center of the ski where it is important to retain a fairly sharp edge to assist the skier in carving desired turns.

Accordingly, it is a primary object of the present invention to provide a new and improved means for beveling the metal edges of alpine snow skis in an automated manner.

It is another object of the present invention to provide a new and improved device for beveling the edges of snow skis which attains uniform and predictable results.

It is another object of the present invention to provide a device for beveling the edge of metal skis which enables ski edges to be beveled in a more expeditious and uniform manner to reduce labor costs involved in the tuning of snow skis.

Other aspects, features and details of the present invention can be more completely understood by reference to the following detailed description of the preferred embodiment, taken in conjunction with the drawings, and from the appended claims.

DESCRIPTION OF THE DRAWINGS

FIGS. 11, 12 and 13 are operational, diagrammatic views illustrating the method for determining and reading the angle of bevel established with the device of the present invention.

FIGS. 11A, 12A and 13A are enlarged, fragmentary transverse sectional views of a portion of the bottom of the ski in which the metal edge is mounted illustrating the angle of bevel imparted to the metal edge in correspondence with the relationship of the device of the present invention to the ski as illustrated in FIGS. 11, 12 and 13.

DESCRIPTION OF THE PREFERRED EMBODIMENT

Figure 1:
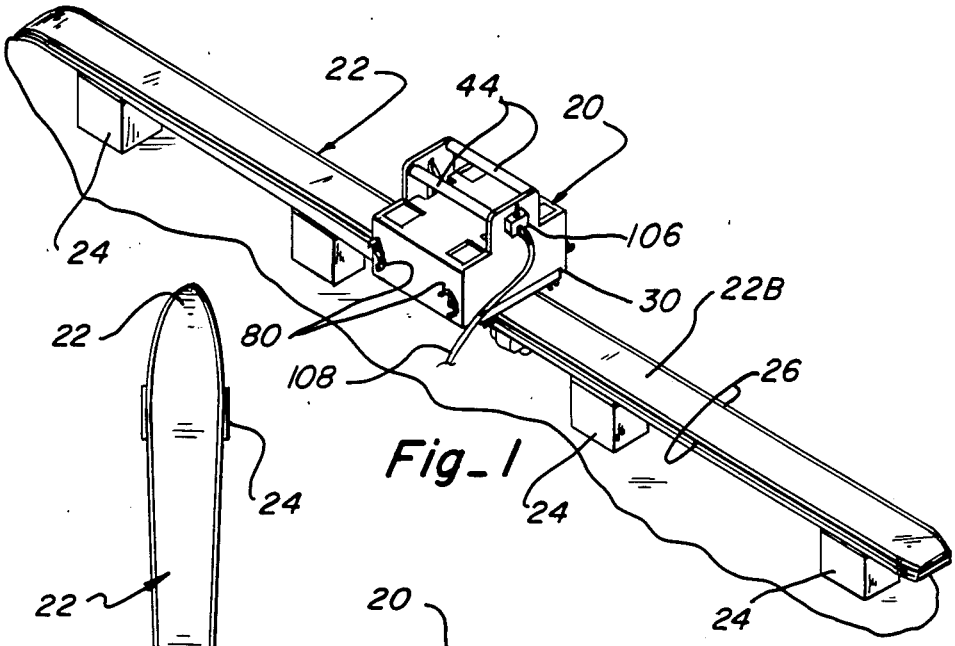
FIG. 1 is a perspective view of a snow ski mounted on supporting blocks and with the device of the present invention in position to grind the metal edges of the ski.

Referring first to FIG. 1, the ski tuning device 20 of the present invention is shown supported on the bottom surface 22B of an inverted snow ski 22 with the snow ski being releasably secured to supporting blocks 24 in any suitable manner so that the bottom surface of the ski is disposed in a substantially flat, planar, upwardly directed orientation.

Figure 2:
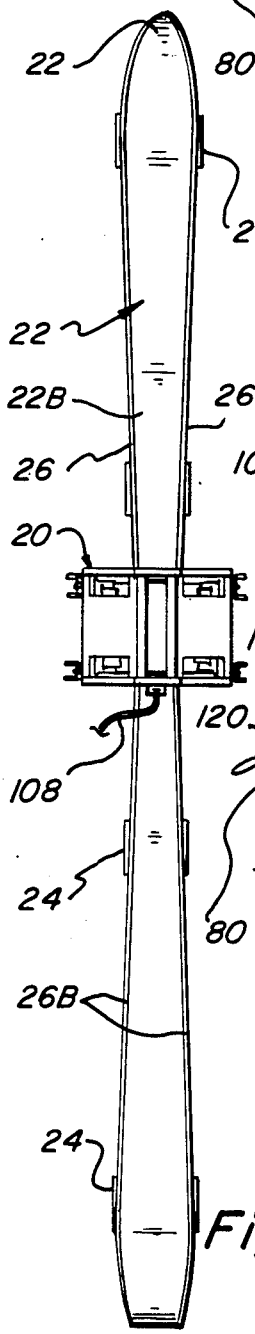
FIG. 2 is a top plan view of the ski and device of the present invention as shown in FIG. 1.
Figure 3:
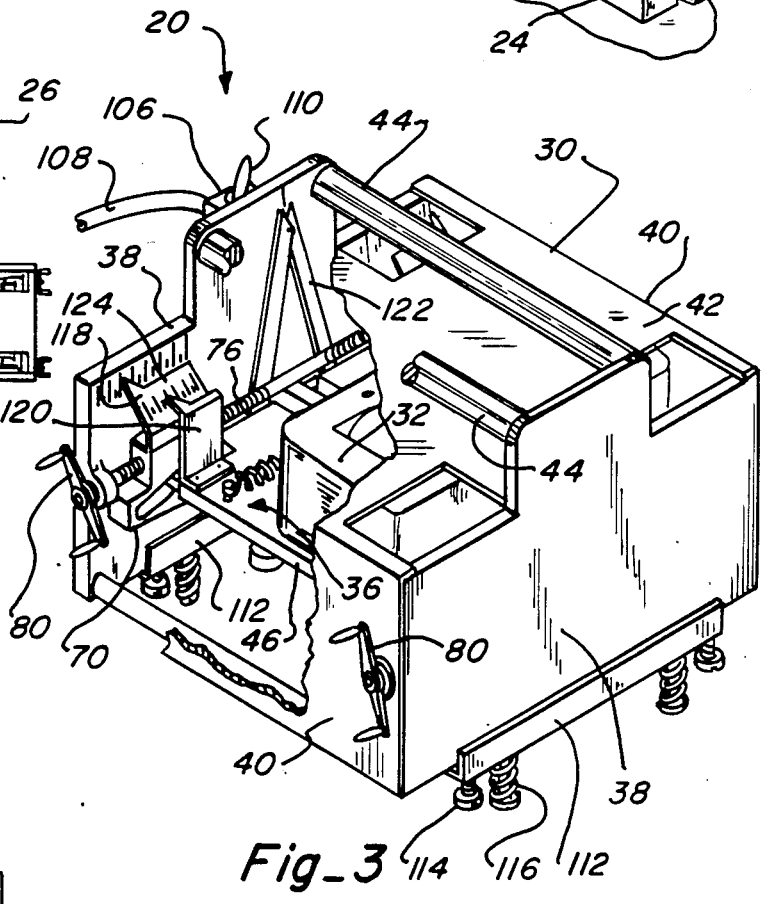
FIG. 3 is a perspective view of the device of the present invention with parts broken away for clarity.
Figure 6:
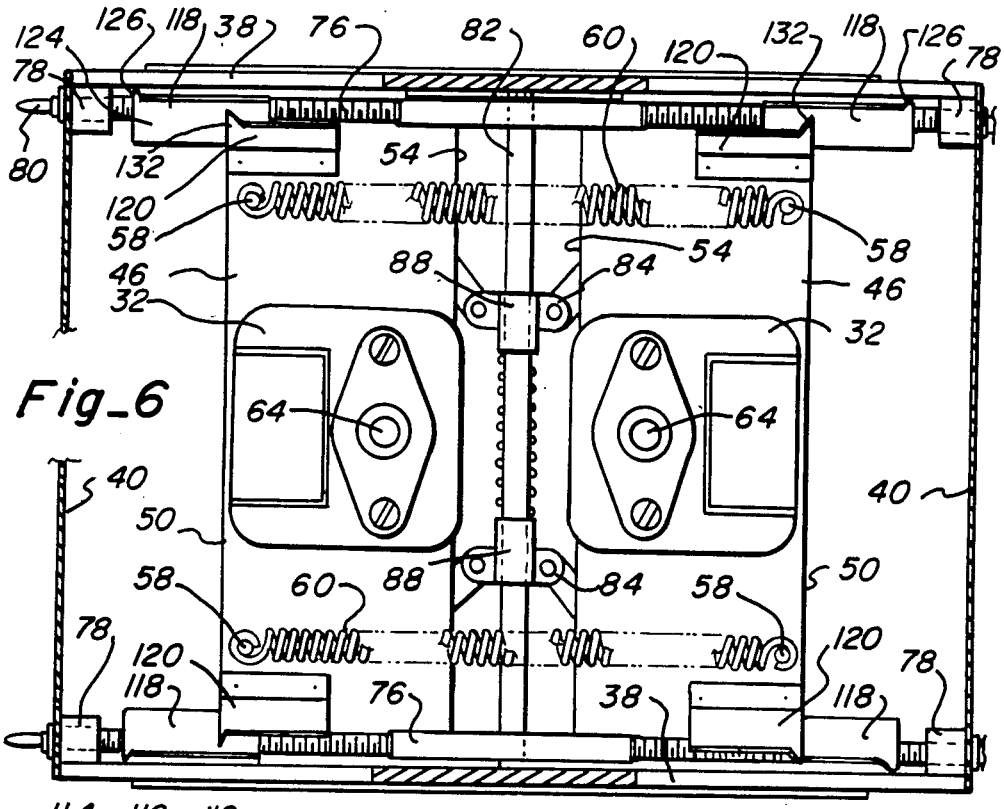
FIG. 6 is a section taken along line 6—6 of FIG. 5.

A typical alpine snow ski 22, as illustrated in FIGS. 1 and 2, can be seen to be an elongated slat, which may be made of any suitable material such as wood, plastic, fiberglass or combinations thereof, and has an upturned tip 22T at its leading end. As best seen in FIG. 2, the ski has contoured sides so as to vary in width from its leading end to its trailing end in a manner such that the leading and trailing ends of the ski are relatively wide in comparison with the longitudinal center of the ski. The ski includes metal edges 26 on each side of the bottom thereof which extend the length of the ski and are embedded in grooves 28 (FIGS. 11 through 13) established on each side of the ski so that the bottom surface 26B of each edge is contiguous with the bottom surface 22B of the ski and is substantially coplanar therewith. As can be seen in FIGS. 11 through 13, the metal edges 26 are of generally square, transverse cross-section.

The ski tuning device 20 itself is probably best seen in FIGS. 3 through 10 to consist of a frame member 30, a pair of electric motors 32 operatively connected to driven grinding wheels 34, and an operative mechanism 36 for changing the disposition of the grinding wheels relative to the frame member 30 in a manner to be described in detail hereinafter. The frame member includes a pair of end walls 38, a pair of side walls 40 connected to the end walls, and a top wall 42. A pair of tubular members 44 interconnect the end walls near the center thereof and adjacent to the top edge of the end walls to form a handle that can be gripped by a user of the tuning device.

Figure 10:
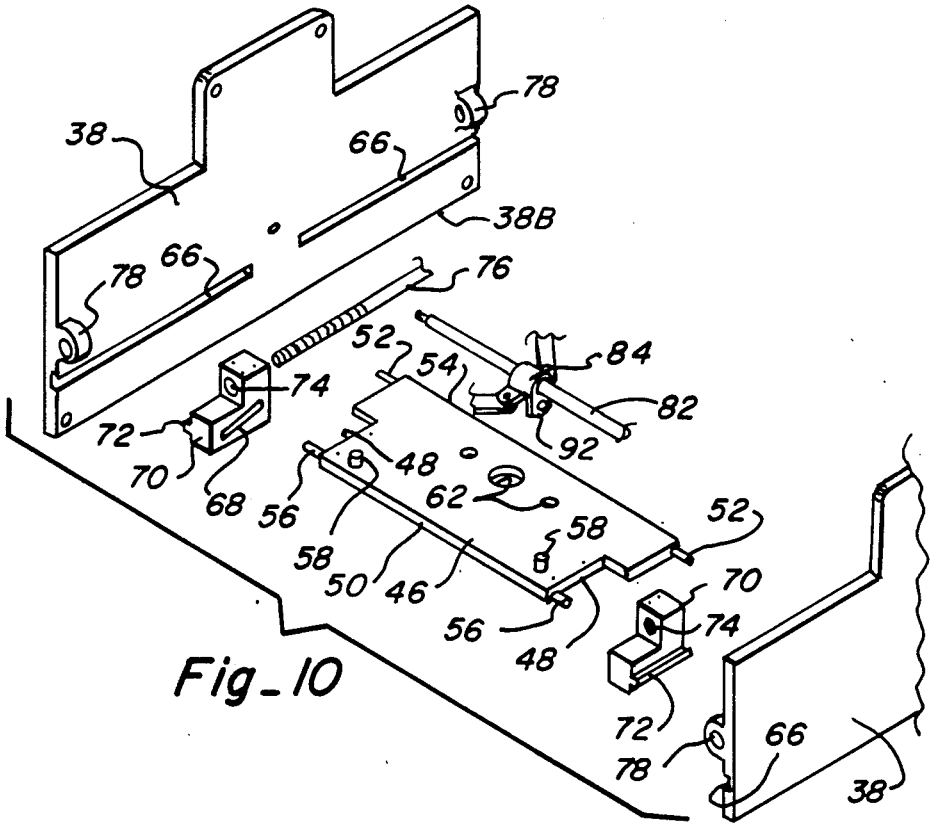
FIG. 10 is an exploded perspective view illustrating various component parts of the device of the present invention.

The operative mechanism 36 includes a pair of slideable plates 46 (best seen in FIG. 10) which are disposed in a generally horizontal orientation when the device is positioned on the horizontal bottom surface of the inverted ski. For purposes of this disclosure and the description of the component parts of the tuning device, it will be assumed that the device is supported on a horizontal surface. The slideable plates 46, as seen in FIG. 10, are generally rectangular in configuration having a pair of rectangular notches 48 formed in opposite ends along the outside edge 50 thereof for a purpose to be described later. A first pair of pins 52 extend longitudinally away from opposite ends of each slideable plate adjacent its inside edge 54, and a second pair of pins 56 extend longitudinally away from opposite ends of each slideable plate adjacent its outside edge 50 so as to be disposed within the notches 48. A pair of spring anchor brackets 58 protrude upwardly from the top surface of each slideable plate near the second pair of pins 56 and are adapted to anchor one end of a tension spring 60 to be described later. Adjacent the inside edge 54 of each plate 46 and at the longitudinal center thereof, a series of three holes 62 are provided through the plate so that one of the electric motor 32 can be mounted on the upper surface of the plate with a driven rotatable shaft 64 extending through the center one of the hole 62. The remaining two holes receive fasteners to anchor the motor to the associated plate 46.

The driven shaft 64 of each motor has one of the grinding wheels 34 operatively connected thereto with the grinding wheel being composed of a material suitable for grinding the metal edges of the ski. As will be appreciated, the driven shaft of each motor extends perpendicularly to the slideable plate 46 so that when the plate is disposed in a horizontal orientation, the driven shaft 64 is disposed vertically and the grinding face 34G of the associated grinding wheel is disposed parallel to the plate 46 and facing downwardly.

As best seen in FIG. 10, each end wall 38 has a pair of horizontal slots 66 formed in its inner surface near the bottom edge 38B with the slots being longitudinally aligned with each other and opening through the outer side edges of the end wall. The first pair of pins 52 in each slideable plate 46 are adapted to be slideably received in an associated slot 66 whereby the slideable plate can be moved in a horizontal direction laterally of the frame member 30. The second pair of pins 56 on each slideable plate are adapted to ride in a cam slot 68 provided in a cam block 70 with the cam blocks also being seen in FIG. 10.

The cam blocks 70 are essentially L-shaped in configuration having a horizontally disposed bead 72 protruding from an outside face which is adapted to be slideably received in one of the slots 66 in the end walls 38. There are four of the cam blocks, one for each slot 66. The inside face of each cam block has the cam slot 68 formed therein. It will be appreciated that the cam blocks can be moved laterally of the frame member 30 within the slots 66 provided in the end walls, and the slideable plates 46 can be moved laterally of the frame member independently of the cam blocks.

Since the second pair of pins 56 are received in the cam slots 68 and the cam slots are angled downwardly and outwardly relative to the slots 66 in the end walls, relative movement of the slideable plates 46 and the cam blocks 70 will cause the outside edge 50 of the slideable plate to move up or down as the plate is moved laterally, causing the plate to tilt slightly relative to horizontal. Accordingly, as will be appreciated, lateral horizontal movement of the slideable plate 46 will cause the plate to pivot slightly about its first pair of pins 52 due to the sliding movement of the second pair of pins 56 in the cam slots 68.

The cam blocks 70 each have a threaded passage 74 through an upper portion thereof with the passage extending laterally of the frame member 30 and adapted to receive one end of a double reverse-threaded adjustment shaft 76. There are two adjustment shafts 76 with one mounted adjacent to one end wall 38 and the other mounted adjacent to the other end wall 38. The ends of the adjustment shafts 76 are threadedly received in the threaded passages 74 of the cam blocks. It should be pointed out that the threads at opposite ends of the adjustment shafts are oppositely threaded so that rotation of the shaft will cause the cam blocks 70 to be simultaneously moved toward each other or simultaneously moved away from each other, depending upon the direction of rotation of the adjustment shaft. The opposite ends of the adjustment shafts are rotatably journaled in bearing blocks 78 protruding inwardly from the adjacent end wall 38, and handle members 80 are attached to opposite ends of the adjustment shafts to facilitate rotation of the shafts. Rotation of the shafts will thus effect movement of the cam blocks 70 along the guide slots 66 in the end walls.

A centrally disposed, longitudinally extending guide rod 82 passes between the end walls 38 at the transverse center thereof and near the lower edge of the end walls so as to be substantially coplanar with the slideable plates 46. The guide rod 82 serves as a guide for a pair of guide link mechanisms 84.

Figure 4:
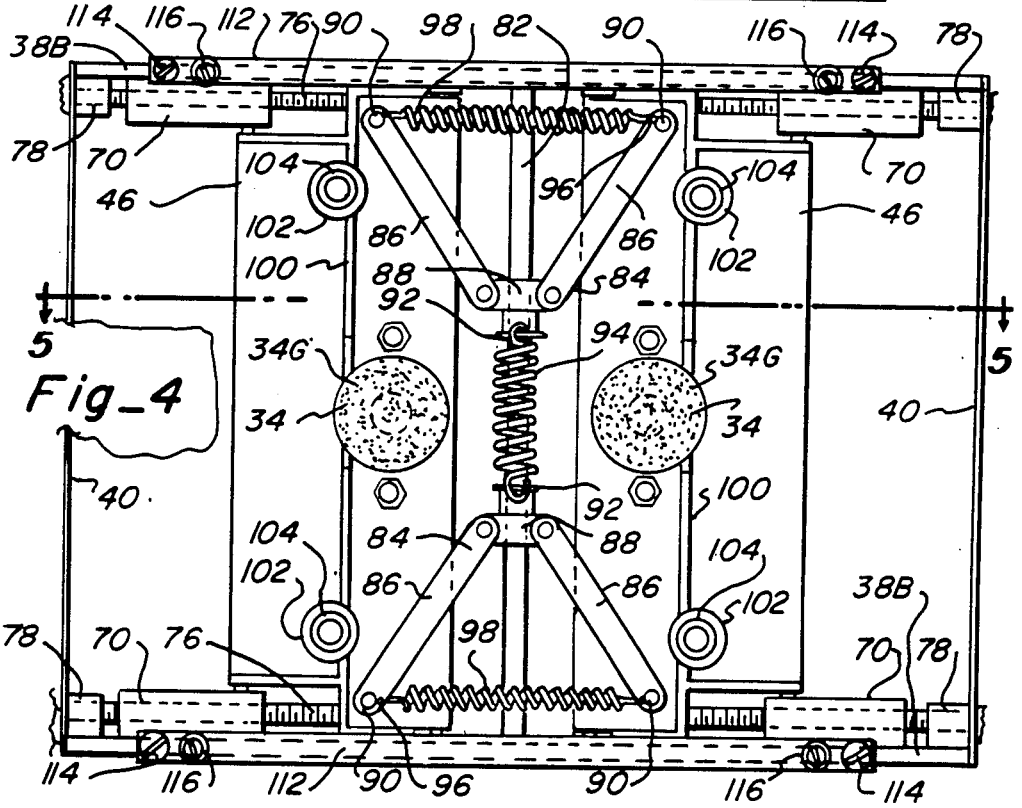
FIG. 4 is a bottom plan view of the device shown in FIG. 3.

Each guide link mechanism, as is probably best seen in FIG. 4, includes a pair of link arms 86 pivotally connected at an inner end to a slide member 88 and pivotally connected at their outer ends to a downwardly projecting pin 90 from the bottom surface of the associated slideable plate 46 and adjacent to an end wall 38. The slide member 88 has a tubular sleeve slideably mounted on the guide rod with oppositely directed attachment arms 90 pivotally connected to the inner ends of the link arm 86 as by a pivot pin. The slide member 88 also includes a downwardly extending attachment finger 92 disposed perpendicularly to the attachment arms 90 and having means thereon for securing one end of a tension spring 94, which serves to bias the slide members 88 toward each other. This biasing force, through the link arms, places an indirect force on the slideable plates 46 biasing them in a horizontal direction toward each other. The link arms 86 have openings 96 therethrough near their outer ends which are adapted to anchor opposite ends of a pair of tension springs 98, which also bias the slideable plates 46 in a horizontal direction towards each other. The previously mentioned tension springs 60 interconnect the slideable plates by being connected to the brackets 58 described previously as projecting upwardly from the slideable plates so that this pair of springs is disposed on the top side of the plates and again biases the plates in a horizontal direction towards each other. As will be appreciated, the tension springs are mounted both above and below the plates 46 encouraging the plates to slide smoothly in the guide slots 66 provided in the end walls by providing a substantially uniform pull from both above and below each plate.

Figure 5:
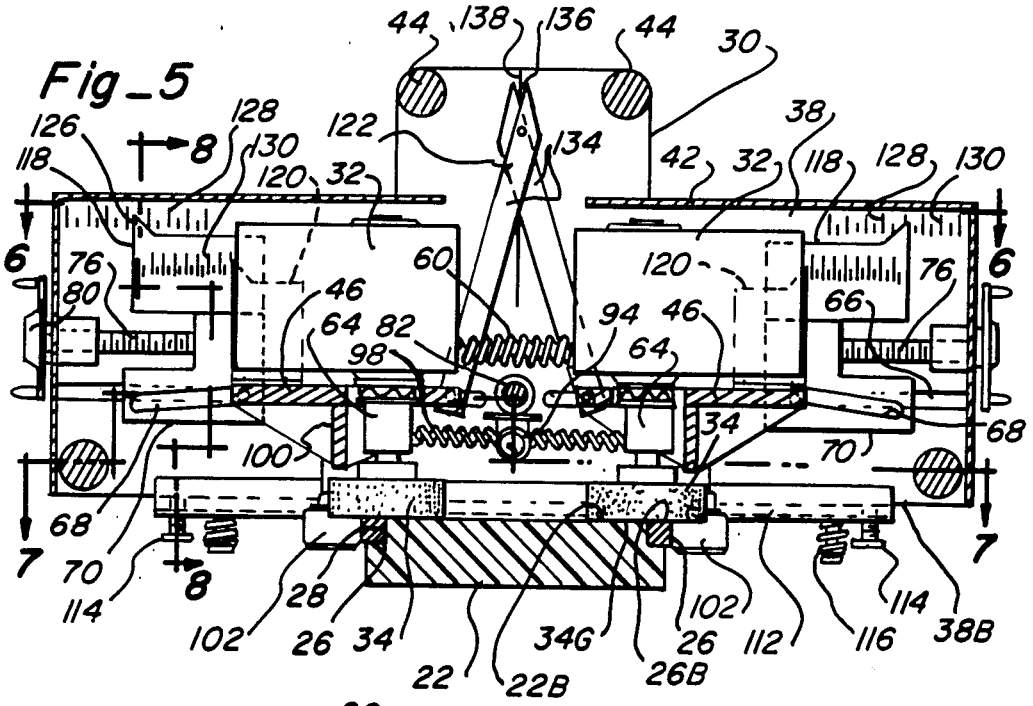
FIG. 5 is a section taken along line 5—5 of FIG. 4.
Figure 7:
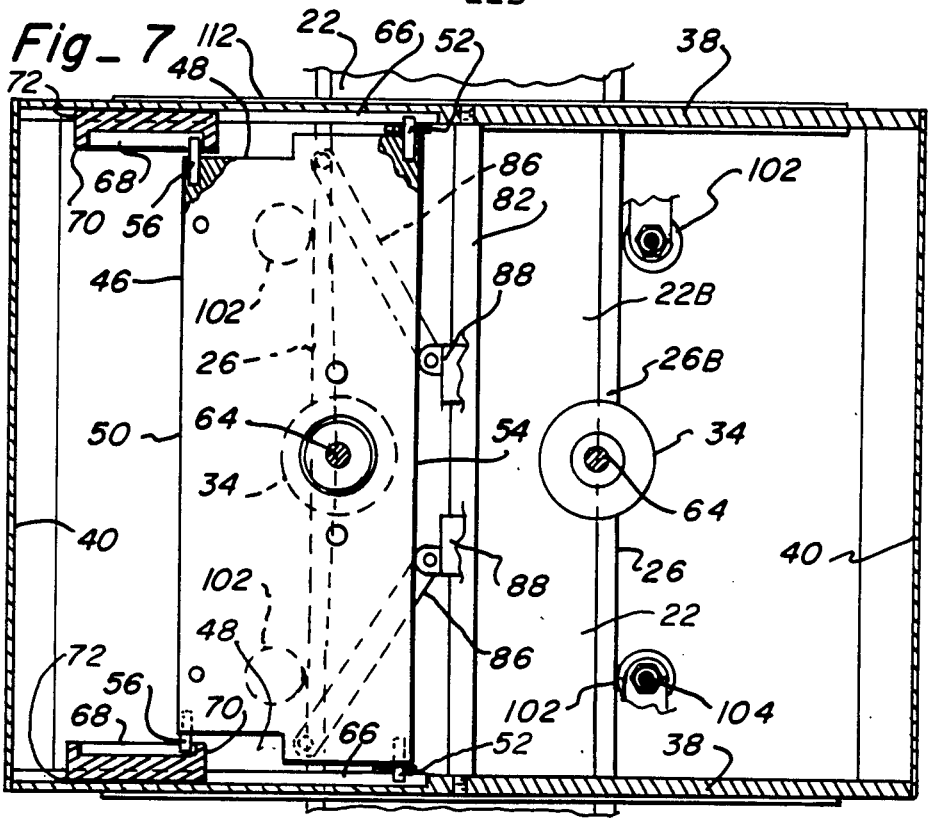
FIG. 7 is a section taken along line 7—7 of FIG. 5.
Figure 8:
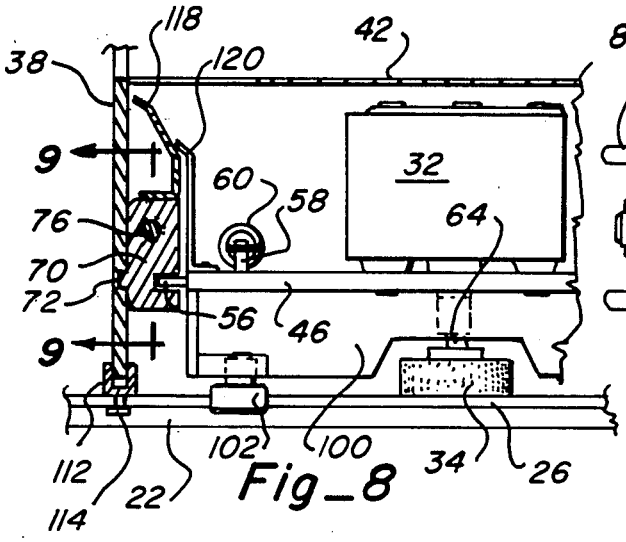
FIG. 8 is a section taken along line 8—8 of FIG. 5.
Figure 9:
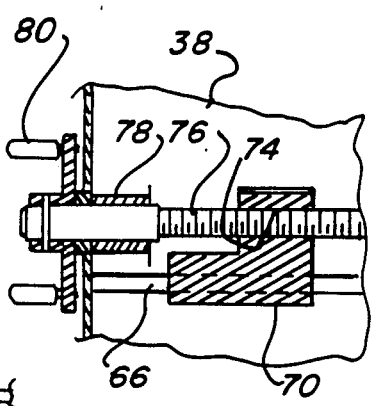
FIG. 9 is an enlarged, fragmentary section taken along line 9—9 of FIG. 9.

Looking next at FIGS. 4 and 5, it will be appreciated that a gussetted angle iron mounting bracket 100 is secured to the bottom surface of each slideable plate 46 so as to extend longitudinally thereof. The bracket 100 supports a pair of guide rollers 102 in bearings 104 provided at opposite ends of the bracket with the rollers being adapted to rotate about a vertical axis. As can be appreciated by reference to FIGS. 11 through 13, the guide rollers 102 protrude downwardly a slight distance further than the grinding wheels 34 so that the guide rollers can engage the sides of the ski 22 when the grinding wheel is in engagement with the bottom surface of the metal edges 26B. It is important to note that the guide rollers are laterally spaced a fixed distance from the centers of the grinding wheels so that the centers of the grinding wheels are vertically aligned with the inside edge of the associated metal edge when the guide rollers are engaged with the sides of the ski.

As will be appreciated, with the guide rollers engaged with the sides of the ski, and as the tuning device is moved along the length of the ski, the guide rollers will follow the contoured sides of the skis and move the slideable plates 46 inwardly and outwardly as the ski becomes narrower and wider respectively. The rollers 102 force the slideable plates horizontally outwardly against the bias placed on the plates by the various tension springs as the ski gets wider. The rollers also allow the plates to move horizontally inwardly toward each other under the bias of the various tension springs at locations along the ski where it is relatively narrow.

The electric motors 32 which rotate the grinding wheels 34 and are securely mounted on the top side of the slideable plates 46 are electrically connected through a switchbox 106 to a power source via an electrical cord 108. The switchbox has an on/off toggle switch 110 so that when power is supplied to the switchbox, the motors can be energized or de-energized by manipulation of the toggle switch.

The bottom edge 38B of each end wall 38 of the frame means has a depth adjustment bar 112 connected thereto with the depth adjustment bar serving to support the tuning device 20 on the bottom surface 22B of the ski. In other words, as the tuning device 20 is moved along the length of the ski, it slides along the bottom surface of the ski on the depth adjustment bars 112. Each depth adjustment bar is channel shaped and is slideably received on the bottom edge 38B of the associated end wall 38 for vertical adjustment. Adjustment screws 114 are threadably passed through each depth adjustment bar near opposite ends thereof so as to engage the bottom edge 38B of the associated end wall whereby the spacing of the depth adjustment bar from the bottom edge of the end wall can be regulated. Compression springs 116 are also operatively connected to opposite ends of the depth adjustment bars and the lower edges of the end walls 38 to bias the depth adjustment bars toward the lower edges of the end walls with the adjustment screws 114 counteracting the bias. The depth adjustment bars 112 are primarily utilized to adjust the spacing of the grinding surface 34G of the grinding wheels from the bottom surface 26B of the metal edge 26 on the ski so that the grinding wheels will grind the metal edges of the ski at a desired depth. This is particularly useful when the grinding surfaces 34G are worn down, as the depth adjustment bar can be adjusted so as to be closer to the bottom edge 38B of the end wall thereby bringing the grinding surface back into engagement with the metal edges 26.

The tuning device includes three sets of calibrated indicators best seen in FIGS. 3, 5 and 11 through 13. The first set of indicators 118 advises the operator of the device as to the width of the ski, the second set of indicators 120 advises the operator as to the angle of the grinding wheels 34 relative to the bottom of the ski 22B, and the third set 122 advises the operator as to the lateral location of the device 20 on the ski 22.

The first set of indicators 118 consists of four vertical plates 124 each being mounted securely on the top surface of one of the cam blocks 70. Each vertical plate 124 has a pointed finger 126 adapted to cooperate with printed and calibrated linear measurement indicia 128 disposed on the inner surface of the associated end wall 38 whereby the pointed finger 126 will indicate on the printed indicia 128 the relative width of the ski. As mentioned previously, the guide rollers 102 are adapted to be advanced inwardly toward the sides of the ski by rotation of the adjustment shafts 76 which move the cam blocks 70 and concurrently the slideable plates 46 on which the guide rollers are mounted. Movement of the cam blocks moves the vertical plates 124 and the pointed finger 126 indicates on the calibrated indicia 128 the lateral separation of the rollers 102 and thus the width of the ski when the rollers are moved into engagement with the sides of the ski.

Each vertical plate 124 also carries calibrated indicia 130 thereon set forth in degrees. The indicia 130 is adapted to cooperate with a second pointed finger 132, forming a part of the second set 120 of four indicators that is mounted on one end of a slideable plate 46. The calibrated indicia 130 is adapted to indicate the relative angle between the slideable plate and the bottom surface 22B of the ski. This angle is also the angle formed between the bottom grinding surface 34G of the associated grinding wheel and the bottom surface of the ski. As the slideable plate 46 tilts through its sliding movement in the cam slot 68, the pointed finger 132 will move relative to the calibrated indicia 130 on the vertical plate 124 relating to degrees to indicate the relative angle between the grinding surface 34G and the bottom surface of the ski.

The third set of indicators 122 on the device 20 relates to a system for maintaining the device in a laterally centered relationship with the ski and includes two pair of indicator link arms 134 with a pair being disposed at each end of the device. The lower ends of the link arms 134 are each pivotally mounted on one of the first pair of pin members 52 protruding from each end of the slideable plates 46. The upper ends of the link arms 134 are pivotally connected to each other by a pivot pin and have a notch 136 defined therebetween which can be aligned with a vertical center line indicator 138 inscribed on the inner surface of the associated end wall 38. When the ski tuning device is centered on the ski, the notch 136 formed at the upper end of the pair of link arms 134 will be aligned with the associated center line indicator 138, but should the tuning device be moved laterally of the ski so that it is not centered thereon, the notch 136 at the upper end of the link arms will be moved to one side or the other of the center line to advise the operator that the device is no longer centered on the ski.

In the operation of the device, a ski 22 is first inverted and secured in any suitable manner such as on the support blocks shown in FIGS. 1 and 2, so that the bottom surface 22B of the ski forms a substantially horizontal plane. The tuning device 20 is then placed on the ski at approximately its longitudinal center where the ski has its narrowest width. Of course, to properly place the device on the ski, the guide rollers 102 have to be spaced a greater distance apart than the width of the ski, and this can be accomplished through rotation of the adjustment shafts 76. With the device positioned on the ski in this manner so that the guide rollers 102 are spaced laterally a slight distance from the sides of the ski, the adjustment shafts can again be rotated in an opposite direction to advance the guide rollers inwardly into engagement with the sides of the ski. The guide rollers move laterally upon rotation of the adjustment shafts since the cam blocks 70 move inwardly toward each other with rotation of the adjustment shafts until the guide pins 56 on the slideable plates 46, which are disposed in the cam slots 68 of the cam blocks, are engaged by one end of the cam slots, forcing the plates 46 to slide inwardly. The plates 46 will slide inwardly until the guide rollers 102, which are mounted on the slideable plates, engage and thus sense the sides of the ski. In this position of the device, the width of the ski can be read on the first calibrated scale 128 so that the operator knows what size ski he is tuning. With the guide rollers in slight engagement with the sides of the ski, the electric motors 32 are energized by switching the toggle switch 110 ot its "on" position, which initiates a rotation of the grinding wheels 34. The tuning device can then be moved longitudinally of the ski while maintaining the depth guide adjustment bars 112 in engagement with the bottom surface of the ski so that the grinding wheels slide along the bottom surface 26B of the metal edges 26 which are in vertical alignment therewith. As will be appreciated, as the guide rollers are moved along opposite contoured sides of the ski, and the ski widens near the leading and trailing ends thereof, the guide rollers are forced away from each other, thus forcing the slideable plates 46 to move away from each other whereby the second pair of pins 56 on each plate, which are disposed in the cam slots 68, are forced downwardly in the cam slots, causing the associated slideable plate to pivot slightly about its first pair of pin members 52. As the slideable plates pivot slightly, the lower longitudinal grinding surfaces 34G on the grinding wheels are also tilted accordingly and grind a beveled surface on the metal edges of the ski. The greater the width of the ski, the greater the bevel, due to the fact that the further the slideable plates are moved laterally outwardly, the greater the degree of pivot.

As mentioned previously, the angular relationship between the bottom surface 22B of the ski and the slideable plates 46, and thus the grinding wheels 34, are indicated on the second calibrated indicia 130 whereby the operator can visually determine the amount of bevel that is being placed on the metal edges of the ski. By way of example, if it is desirable at the narrowest part of the ski, i.e. that portion of the ski near its longitudinal center, to have a side edge bevel of 0.5 degrees relative to the bottom of the ski, as is best illustrated in FIG. 11A, before the device is turned "on", the angle of the grinding wheels should be set to 0.5 degrees. This is accomplished by continuing to move the cam blocks 70 toward each other through rotation of the adjustment shafts 76 after the guide rollers 102 have engaged the sides of the ski. This will cause sliding movement of the cam blocks 70 relative to the slideable plates 46 so that the second set of pins 56 on the slideable plates will be forced downwardly in the cam slots 68 causing the plates and the grinding wheels to tilt. The cam blocks are thus moved inwardly toward each other until the tilt of the grinding wheels is indicated on the second calibrated indicia to be 0.5 degrees.

With the device set in this manner, the electric motors 32 can be energized to operate the grinding wheels and the device then moved along the length of the ski. In the preferred embodiment of the device and in its use on a typical ski, if the bevel at the narrowest part of the ski was 0.5 degrees, the bevel at the widest part, as seen in FIG. 13A would automatically be ground at approximately 1.5 degrees. Of course, the bevel at the narrowest part of the ski can be preselected as desired so that if this bevel was selected to be 1 degree, for example as shown in FIG. 12A, the bevel at the widest part of the ski would automatically be ground to approximately 2.0 degrees. Of course, between the narrowest and widest parts of the ski, the bevel will vary smoothly in accordance with the varying width of the ski.

Although the present invention has been described with a certain degree of particularity, it is understood that the present disclosure has been made by way of example, and changes in detail or structure may be made without departing from the spirit of the invention, as defined in the appended claims.

What is claimed is:

1. A device for filing the bottom edge of a ski wherein the ski varies in width along its length comprising in combination, frame means adapted to be moved along the length of the ski, motor means mounted on said frame means, grinding means operably connected to said motor means and adapted to engage the bottom edge of said ski as the frame means is moved along the length of the ski, and operative mechanism means on said frame means adapted to adjust the angle of said grinding means relative to the bottom of the ski whereby the edge can be ground at an angle relative to the bottom of the ski.

2. The device of claim 1 wherein said operative mechanism means includes sensing means to sense the width of the ski and through said operative mechanism means adjust the angle of the grinding means relative to the bottom of the ski in a direct relation to the width of the ski.

3. The device of claim 2 wherein said sensing means includes follower means adapted to be moved along opposite sides of said ski as the frame means is moved along the length of the ski.

4. The device of claim 3 further including slideable plate means operably mounted on said frame means, said follower means being operably connected to said slideable plate means, and wherein said grinding means are operably connected to said slideable plate means for movement therewith, whereby the grinding means is caused to follow the edge of the ski as the frame means is moved along the length of the ski.

5. The device of claim 4 further including cam means mounted on said frame means and operably associated with said slideable plate means to change the angle of said plate means and the grinding means relative to the bottom surface of the ski as the frame means is moved along the length of the ski and the follower means senses the varying width of the ski.

6. The device of claim 5 further including yieldingly resistant biasing means for retaining the follower means in engagement with the sides of the ski.

7. The device of claim 6 wherein said cam means effects a greater angle between the slideable plate means and the bottom of the ski at locations where the ski is relatively wide than at locations where the ski is relatively narrow.

8. The device of claim 7 further including calibrated indicator means for indicating the relative angle between the slideable plate and the bottom of the ski.

9. The device of claim 8 wherein said frame means has a pair of end walls, each end wall having a slot therein, and wherein said slideable plate means consists of two plate member having pin means at opposite ends thereof received in said slots so that said plate means can slide along said slots and also be pivoted about said pin means.

10. The device of claim 9 wherein said cam means consists of two pair of block members operably mounted on said end walls adjacent to said slideable plates and having a guide surface thereon forming an angle with the slots in said end walls, said slideable plates having additional pin means thereon adapted to cooperate with said guide surface to cause said slideable plates to pivot about said first mentioned pin means as the first mentioned pin means slide along said slots.

11. The device of claim 10 wherein said block members are movable relative to said end walls to cause the slideable plate means to move in a reversible lateral direction relative to the ski.

12. The device of claim 11 further including biasing means to urge the slideable plate members toward each other in a lateral direction relative to the ski to maintain the follower members in engagement with the sides of the ski.

13. The device of claim 12 wherein said grinding means consists of two grinding wheels, each being associated with one of the slideable plate members.

14. The device of claim 13 wherein each grinding wheel has a bottom grinding surface that remains in a plane parallel to the slideable plate member with which it is associated.

15. A device for filing the bottom edge of a ski wherein the ski varies in width along its length comprising in combination, frame means adapted to be moved along the length of the ski, grinding means operably mounted on said frame means, and operative mechanism means on said frame means, operably associated with said grinding means and adapted to sense the width of the ski, said operative mechanism means including means for varying the angle of said grinding means relative to the bottom of the ski in a direct relation to the width of the ski.

* * * * *

UNITED STATES PATENT AND TRADEMARK OFFICE

CERTIFICATE OF CORRECTION

PATENT NO. : 4,679,356

DATED : July 14, 1987

INVENTOR(S) : Jacques R. Thomas

It is certified that error appears in the above-identified patent and that said Letters Patent is hereby corrected as shown below:

On the title page, item [76], "Jacques B. Thomas" should be corrected to read --Jacques R. Thomas--.

Signed and Sealed this

Nineteenth Day of January, 1993

*Attest:*

DOUGLAS B. COMER

*Attesting Officer*

*Acting Commissioner of Patents and Trademarks*